US010422164B2

(12) United States Patent
Cheng

(10) Patent No.: US 10,422,164 B2
(45) Date of Patent: Sep. 24, 2019

(54) LOCK BODY WITH ADJUSTABLE STRIKE PLATE FOR SLIDING DOORS

(71) Applicant: Qianyan Cheng, Sacramento, CA (US)

(72) Inventor: Qianyan Cheng, Sacramento, CA (US)

( * ) Notice: Subject to any disclaimer, the term of this patent is extended or adjusted under 35 U.S.C. 154(b) by 695 days.

(21) Appl. No.: 15/001,010

(22) Filed: Jan. 19, 2016

(65) Prior Publication Data

US 2016/0208526 A1 Jul. 21, 2016

Related U.S. Application Data

(60) Provisional application No. 62/105,469, filed on Jan. 20, 2015.

(51) Int. Cl.

*E05B 65/08* (2006.01)
*E05B 15/02* (2006.01)
*E05B 15/10* (2006.01)

(52) U.S. Cl.

CPC ..... *E05B 65/0858* (2013.01); *E05B 15/0245* (2013.01); *E05B 15/102* (2013.01)

(58) Field of Classification Search

CPC .. E05B 63/127; E05B 65/0858; E05B 15/102; E05B 63/126; E05B 2015/105; Y10T 292/558; Y10T 70/5226; Y10T 292/098

See application file for complete search history.

(56) References Cited

U.S. PATENT DOCUMENTS 573,934 A * 12/1896 Trepte ..... E05B 63/126 70/131
1,083,173 A * 12/1913 Zeckhauser ..... E05B 65/0007 292/139
2,668,073 A * 2/1954 Collar ..... E05B 63/127 292/150
2,720,774 A * 10/1955 Gehrie ..... E05B 65/5261 292/27
3,175,376 A * 3/1965 Cantwell ..... E05B 17/042 292/140
3,582,119 A * 6/1971 Woodworth ..... E05B 63/127 292/146
4,566,725 A * 1/1986 Klein ..... E05B 63/127 292/191
4,615,550 A * 10/1986 Abate ..... E05B 63/127 292/192
5,009,089 A * 4/1991 Lin ..... E05B 63/126 292/49

(Continued)

*Primary Examiner* — Mark A Williams
(74) *Attorney, Agent, or Firm* — Heisler & Associates

(57) ABSTRACT

A dead bolt is provided in a lock shell to be drive-jointed with a drive mechanism. Two hooks are symmetrically set along an access direction of dead bolt in the shell. The hooks are hinged with an elastomer therebetween. A draw ring is set to keep mute upon popup under the action of anti-collision mute strip. A strike plate and strike box assembly have a panel with an elongate groove on at least one end thereof. The elongate groove has a set of slots on at least one side thereof. The strike plate is provided with a fastening hole on each end. The fastening hole has a sidewall extending above the plane of the strike plate with a clip bar at a position able to fit into a corresponding slot in the elongate groove. The clip bar joints the corresponding slot to facilitate alignment adjustability.

9 Claims, 8 Drawing Sheets

(56) References Cited

U.S. PATENT DOCUMENTS 5,516,162 A * 5/1996 Takaishi ..... E05B 63/127
292/34
7,836,737 B2 * 11/2010 Lin ..... E05B 63/127
292/159

* cited by examiner

LOCK BODY WITH ADJUSTABLE STRIKE PLATE FOR SLIDING DOORS

CROSS-REFERENCE TO RELATED APPLICATIONS

This application claims benefit under Title 35, United States Code § 119(e) of U.S. Provisional Application No. 62/105,469 filed on Jan. 20, 2015.

FIELD OF THE INVENTION

This utility model relates to a lock body, to be specific, a handle lock body for sliding doors. It belongs to the technical field of locks and lock accessories. This utility model also relates to a kind of assembly for door locks, to be specific, a kind of strike plate and strike box assembly for door locks which is adjustable to improve fit with a door frame.

BACKGROUND OF THE INVENTION

Most lock bodies used in existing sliding doors have a dead bolt structure, and to enhance tamper resistance, most of them are provided with hooks extending towards both sides of the dead bolt and the contact of hooks with a lock body panel is used to achieve reset. However, applicant has found in practice that existing lock bodies easily cause stuck hooks due to their inability to automatically reset during use and that the dead bolt is prone to deflection after long-term use.

In addition, the lock body used in existing sliding doors is usually provided with a popable draw ring, but as the lock body is made of metal, a harsh metal sound will be produced when the draw ring pops up, which is inconducive to maintaining user comfort.

After search, it is discovered that a Chinese utility model patent titled "An Electric Lock for Sliding Doors" (Application Number 201020119517X and authorized Publication Number CN201661139U) adopts the structure of combined sliding of sliding column and chute to achieve hook stretching and retracting, but a big force is required during the process of thrusting and pulling the hook, which will cause serious wear to sliding column and chute under long-term contact and friction.

Furthermore, during the installation of a door lock, a strike box inserted into the door frame is typically mounted first at a position of the door frame corresponding to the door lock. Then a strike plate is mounted outside the strike box, so as to affix the strike box.

The applicant found in practice that, on the one hand, it is very difficult to align the centerline of the strike box with that of the door lock bolt during installation; on the other hand, the door body will droop due to the door weight or other factors after use for some time, leading to the deviation between the centerline of door lock bolt and that of the strike box. After the occurrence of the above two problems, it is necessary to fine-tune the vertical position of the strike box. However, the existing structure of strike plate and strike box assembly, coupled with the impossibility of freely adjusting the position of fastening hole in a door frame after the fastening hole has been set, makes it impossible to fine-tune the position of the strike box after it is properly affixed on the door frame. Although it is a small problem, it cannot be effectively solved. After search, the existing technologies represented by a Chinese utility model titled "A Mute Strike Box" (Application Number 201320860057.X and authorized Publication Number CN203640400U) have not made effective improvements with respect to the above problem.

SUMMARY OF THE INVENTION

The technical problem to be solved by this invention is overcoming the problems in the existing technologies and providing a handle lock body for sliding doors, which can realize automatic reset of the hook and prevent it being stuck.

A second technical problem to be solved by this invention is on the basis of solving the primary technical problem, avoiding the harsh metal impact sound when the draw ring pops up.

With this structure, under the action of the elastomer and limit post, the hooks can automatically reset when the dead bolt draws back and timely pop up when the dead lock extends out, so as to prevent the hooks getting stuck by the lock body panel.

Preferably, the hooks have a strip-shaped sheet body, one end of the hooks extends out a first protrusion towards the other hook to contact the elastomer and a second protrusion towards the direction against the other hook to contact the corresponding limit post, the other end of the hooks extends out a hook-shaped part towards the direction against the other hook; the hinge point is located near where the hooks are adjacent to the second protrusion.

Preferably, a limit bar is set in the dead bolt shell along the access direction of the dead bolt and the two hooks are distributed symmetrically on both sides of the limit bar.

Preferably, the drive mechanism comprises a dial wheel with a handle and a thrust plate to match the handle, the thrust plate is parallel to the plane of hooks; the dead lock shell is perpendicular to the plane of hooks and to the section of side panel and forms a "C" shape, the plane of hooks is perpendicular to the side panel; the opening end of the "C" shape clamps and is fixedly connected with the thrust plate and its closing end faces the outside of lock shell.

More preferably, the opening end of the "C" shape is permanently connected with the thrust plate with a set of rivets, and the tops of the rivets lie on the same side of the dead lock shell. This can ensure that the dead bolt will not deviate during movement. More preferably, when the dead lock is at the second state and the hooks extend out of the dead lock shell, the second protrusion of the hooks is clamped between the limit post and thrust plate. This can function as spacing and prevent excessive rotation of the hooks. More preferably, a gasket is provided between the said dial wheel and lock shell.

More preferably, the thrust plate has a first slotted hole as a chute, the lock shell has a first positioning column in the first slotted hole, the first positioning column is provided with a sleeve circumferentially to contact the inner wall of the first slotted hole; the said first slotted hole extends along the access direction of the dead lock. In this way, the dead bolt moves smoother and the wear to the first positioning column is reduced, thus its service life is extended.

Preferably, a draw ring and draw ring control mechanism are also set in the lock shell; the side panel is provided with a through hole for the access of draw ring; the side of the draw ring facing the lock shell is permanently connected with a draw ring thrust box, the draw ring thrust box has a second slotted hole as a chute in the middle, the lock shell has a second positioning column in the second slotted hole; the lock shell also has a bracket permanently fixed with at least two first sliding columns, which are parallel to and lie on both sides of the second slotted hole, the draw ring thrust box has a channel for the first sliding columns to pass through, the first sliding columns are provided with an elastomer circumferentially with one end butting the outer wall of the draw ring thrust box and the other end butting the bracket. Thus, both the first sliding columns and the second slotted hole are the movement track of the draw ring, which can ensure the access levelness of the draw ring and prevent it getting stuck by the lock shell due to deviation.

To address the second technical problem, the second slotted hole preferably has an anti-collision mute strip at the end. This reduces the stress of the second positioning column, extend the service life of the lock body; more importantly, this can avoid the harsh metal impact sound when the second positioning column collides with the second slotted hole and make the draw ring keep mute upon popup, which will help improve user comfort.

More preferably, the draw ring control mechanism comprises a cylindrical part, a draw ring positioning plate and a second sliding column; the cylindrical part is arranged along the access direction of the draw ring, one end of the cylindrical part is exposed out of the side panel, and the other end is provided with a channel for the second sliding column to pass through, the second sliding column is fixed on the base of the lock shell, an elastomer is set circumferentially on the second sliding column with one end butting the cylindrical part and the other end butting the base; the draw ring positioning plate comprises a first straight bar and a second straight bar, one end of the first straight bar is hinged with the lock shell and the other end hinged with the sidewall of cylindrical part, the central axes of the two hinge points are parallel to each other; one end of the second straight bar is permanently connected with the middle of the first straight bar and the other end has a slip hook, and the draw ring thrust box has a notch to match the slip hook.

More preferably, the draw ring positioning plate has an axially symmetric pattern, the first and second straight bars are vertical to each other. This makes it unnecessary to distinguish the direction of the positioning plate during assembly and facilitates assembly.

More preferably, the lock shell has a square bar hole at the central axis of dial wheel and mounting holes on both sides of the square bar hole to match machine screw and/or wood screw. This facilitates the assembly of small split buttons. More preferably, the lower part of the lock shell is also provided with a handle mounting hole, the lock shell has a handle hole on both sides of the handle mounting hole. This makes it easy to install a big handle suitable for the disabled, as well as European and American handles.

By applying the structure of this invention, the hooks inside the dead bolt can realize automatic reset and prevent hooks getting stuck by the side panel of the lock body; in the meantime, the draw ring can keep mute upon popup, which will help improve user comfort.

A further technical problem to be solved by this utility model is: overcoming the problems in the existing technologies and providing a kind of strike plate and strike box assembly for door locks to facilitate the fine-tuning of the vertical position of the strike box and provide convenience for the alignment process of strike box and door lock bolt.

To solve the technical problem, the technical scheme of this invention is described. Structurally, the strike plate is permanently connected with the panel of strike box by virtue of the joint between the slot and clip bar. When the fastener connects the strike plate with the door frame, the panel of strike box is fixed and uneasy to slide under the action of the joint structure; when it is necessary to fine-tune the vertical position of the strike box, the fastener is slightly loosened so that the strike plate is slightly loose from the panel of strike box, then the vertical position of strike box is fine-tuned to meet the requirements, after that, the strike plate is fastened with the panel of strike box and the fastener is tightened. The whole fine-tuning process is very simple and convenient.

Preferably, the slots on both sides of the same slotted hole or long groove are symmetrically distributed; the clip bars on the sidewall of the same fastening hole are symmetrically distributed. Preferably, the slots are arranged transversely and parallel to one another; the clip bars are arranged transversely. Preferably, the box of the strike box takes a rectangular shape and its one side opens, the panel of the strike box is rectangular and permanently connected with the opened side of the box. Preferably, the slotted hole or long groove lies on both ends of the panel at the position which reaches beyond the box. Preferably, the fastening hole is tapered. Preferably, the panel and strike plate respectively have a rectangular hole in the middle.

This utility model is skillfully constructed, adopts simple joint structure to effectively solve the problem of fine-tuning the strike box, facilitates fine-tuning of the vertical position of the strike box and brings convenience to the alignment process of the strike box and door lock bolt.

OBJECTS OF THE INVENTION

Accordingly, a primary object of the present invention is to provide a lock body for sliding doors which avoids making excessive noise during operation.

Another object of the present invention is to provide a system and method for adjusting a strike plate relative to a lock body to allow the lock body to precisely fit in a door frame for easy and reliable operation of a sliding door.

Another object of the present invention is to provide a lock body for a sliding door which is easy to use, even by disabled individuals and provides reliable operation to lock and unlock the sliding door.

Other further objects of the present invention will become apparent from a careful reading of the included drawing figures, the claims and detailed description of the invention.

DESCRIPTION OF THE PREFERRED EMBODIMENT

Figure 1:
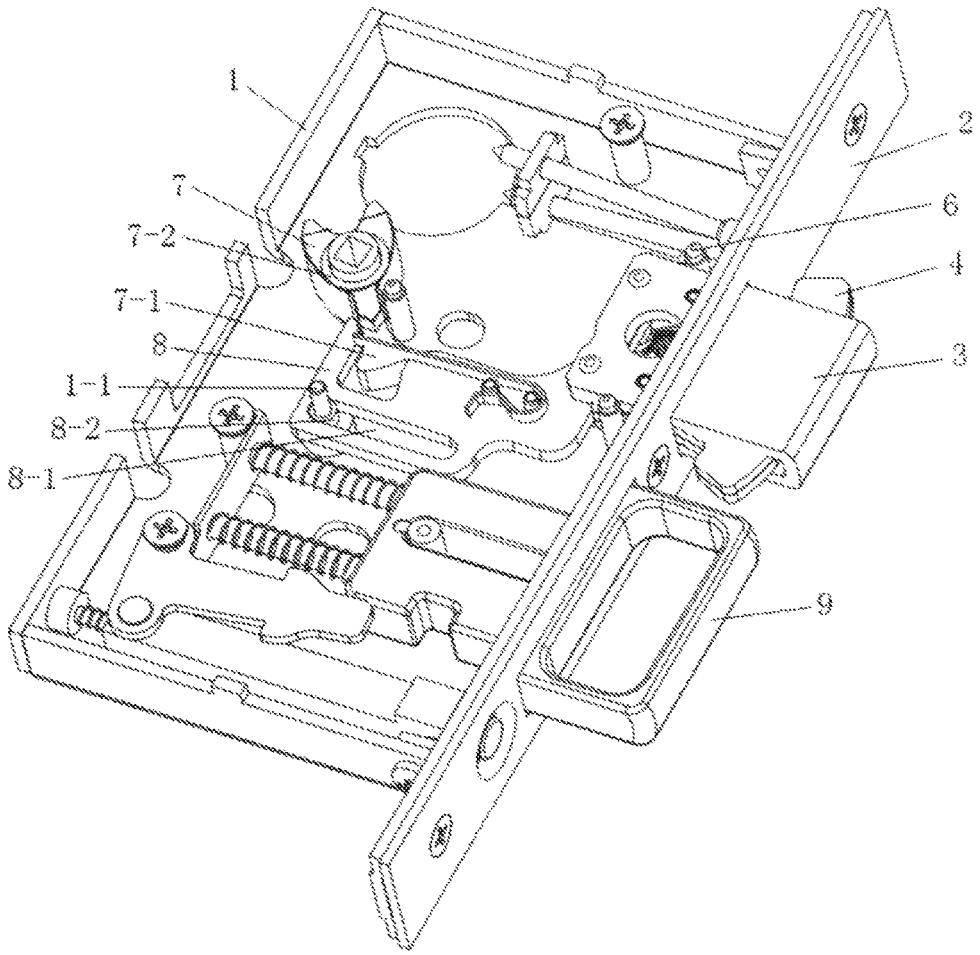
FIG. 1 is a perspective view of a lock body for sliding doors with a cover of a lock shell removed to show the internal structure thereof according to an embodiment of this invention.

Further details of this invention are given by referring to the drawings combined with embodiments in the following pages, but this invention is not limited to the given embodiments.

Lock Body Embodiment

Figure 2:
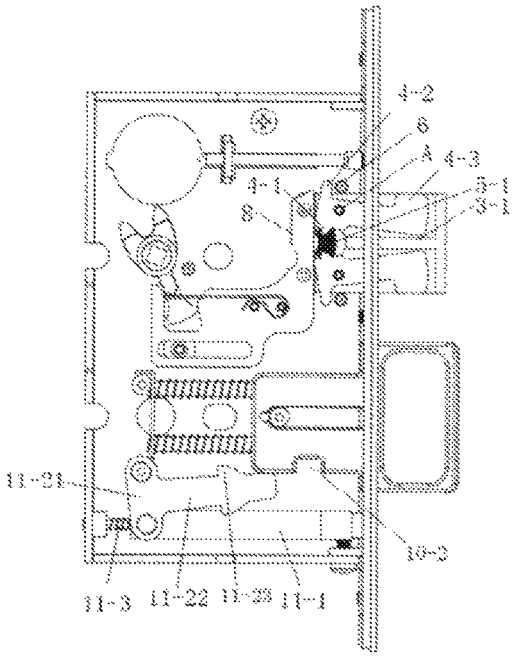
FIGS. 2-5 are side elevation views of the embodiment of FIG. 1 at different states of operation.
Figure 3:
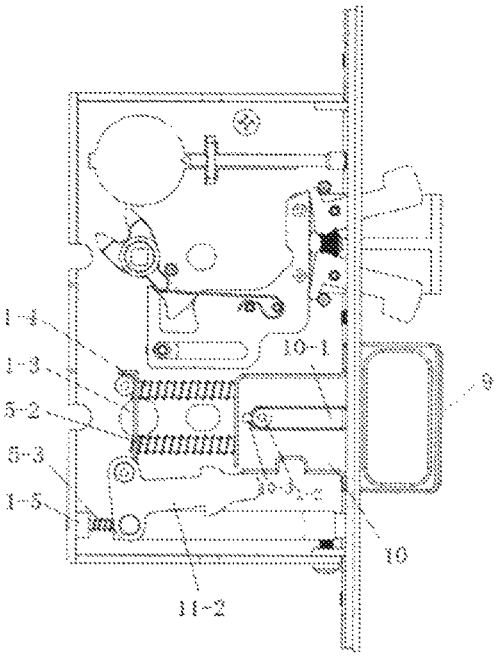
Figure 4:
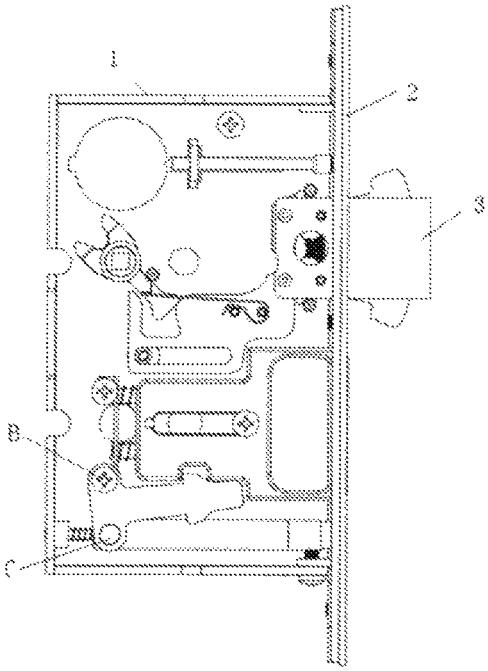
Figure 5:
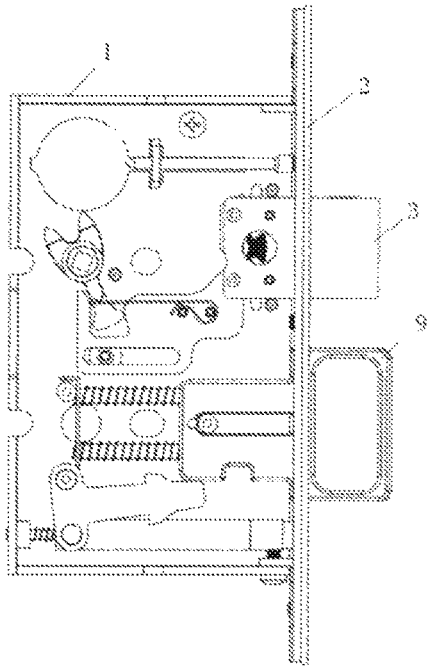
Figure 8:
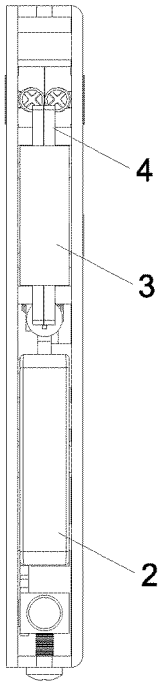
FIGS. 7 and 8 are end elevation views of the embodiment of FIG. 1, with a side panel thereof partially cut away or removed to show interior details.
Figure 7:
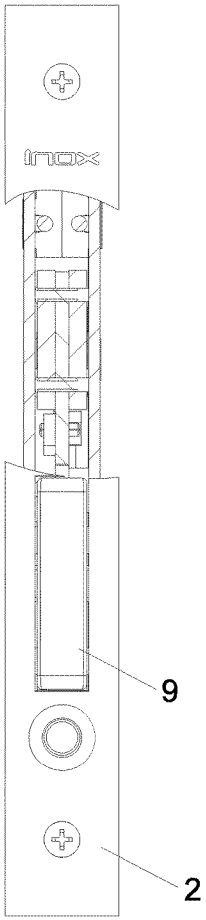
Figure 6:
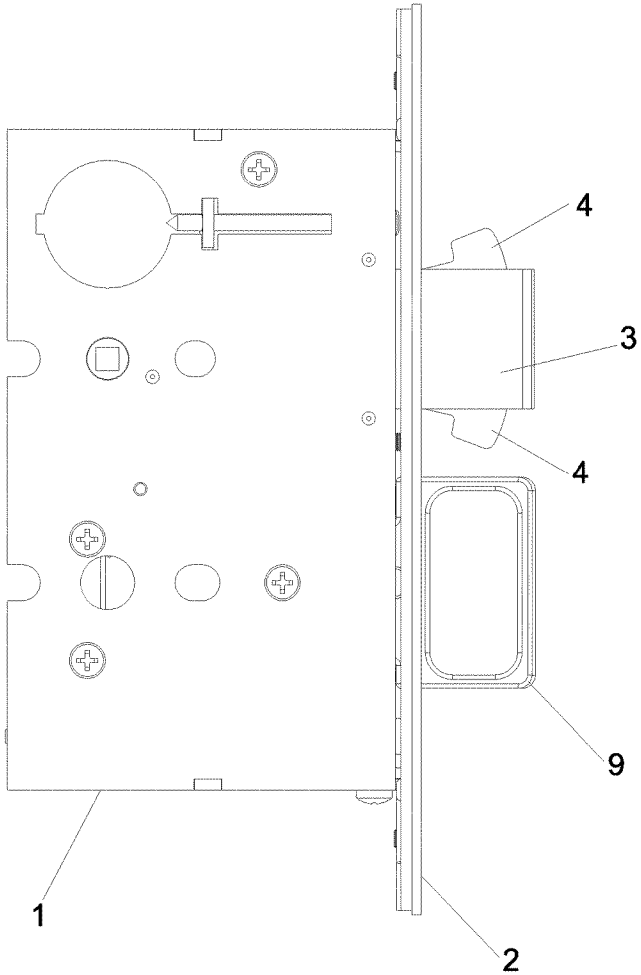
FIG. 6 is a side elevation view of FIG. 3 with the cover of the lock shell in place.
Figure 9:
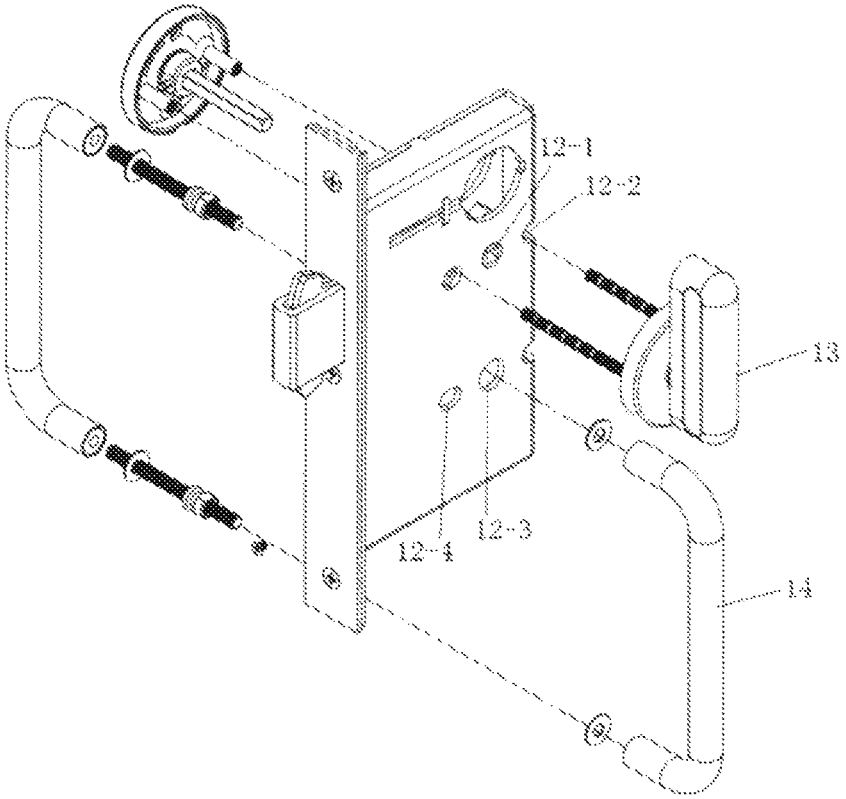
FIG. 9 is a partially exploded perspective view of the embodiment of FIG. 1 with peripheral components also shown.

As shown in FIG. 1 to FIG. 9, the handle lock body for sliding doors in this embodiment, comprising a lock shell 1 and a side panel 2, the side panel 2 is permanently connected with the lock shell 1; a dead bolt 3 is provided in the lock shell 1 to be drive-jointed with the drive mechanism, the side panel 2 has a through hole for the access of dead bolt 3; the dead bolt 3 has a hollow rectangular shell; two hooks 4 are symmetrically set along the access direction of dead bolt 3 in the dead bolt 3 shell; the hooks 4 are hinged with dead bolt 3 shell at the hinge points A which are located between the two ends of the hooks 4; an elastomer 5-1 is set between the hooks 4 where the extending direction intersects the access direction of dead bolt 3; limit posts 6 are provided in the lock shell 1 to correspond to the hooks 4; the dead bolt 3 has the first state that: when the dead bolt 3 extends out of or draws back into the lock shell 1, the elastomer 5-1 resists one end of the hooks 4 to make the hooks 4 positively rotate around the hinge point A till the other end of the hooks 4 retracts into the dead bolt 3 shell, as well as the second state that: when the dead bolt 3 extends out of the lock shell 1 and continues to move towards outside of lock shell 1, limit posts 6 contact one end of the hooks 4 to make the hooks rotate reversely around the hinge point 4 till the other end of the hooks 4 extends out of the dead bolt 3 shell and compress the elastomer.

The hooks 4 have a strip-shaped sheet body, one end of the hooks 4 extends out a first protrusion 4-1 towards the other hook 4 to contact the elastomer 5-1 and a second protrusion 4-2 towards the direction against the other hook 4 to contact the corresponding limit post 6, the other end of the hooks 4 extends out a hook-shaped part 4-3 towards the direction against the other hook 4; the hinge point A is located near where the hooks 4 are adjacent to the second protrusion 4-2.

A limit bar 3-1 is set in the dead bolt 3 shell along the access direction of the dead bolt 3 and the two hooks 4 are distributed symmetrically on both sides of the limit bar 3-1.

The drive mechanism comprises a dial wheel 7 with a handle 7-1 and a thrust plate 8 to match the handle 7-1, the thrust plate 8 is parallel to the plane of hooks 4; the dead lock 3 shell is perpendicular to the plane of hooks 4 and to the section of side panel 2 and forms a "C" shape, the plane of hooks 4 is perpendicular to the side panel 2; the opening end of the "C" shape clamps and is fixedly connected with the thrust plate 8 and its closing end faces the outside of lock shell 1.

The opening end of the said "C" shape is permanently connected with the thrust plate 8 with a set of rivets 9, and the tops of the rivets 9 lie on the same side of the dead lock 3 shell; when the dead lock 3 is at the second state and the hooks 4 extend out of the dead lock 3 shell, the second protrusion of the hooks 4 is clamped between the limit post 6 and thrust plate 8; a gasket 7-2 is provided between the dial wheel 7 and lock shell 1.

The thrust plate 8 has a first slotted hole 8-1 as a chute, the lock shell 1 has a first positioning column 1-1 in the first slotted hole 8-1, the first positioning column 1-1 is provided with a sleeve 8-2 circumferentially to contact the inner wall of the first slotted hole 8-1; the first slotted hole 8-1 extends along the access direction of the dead lock 3.

A draw ring 9 and draw ring control mechanism are also set in the lock shell 1; the side panel 2 has a through hole for the access of draw ring 9; the side of the draw ring 9 facing the lock shell 1 is permanently connected with a draw ring thrust box 10, the draw ring thrust box 10 is provided with a second slotted hole 10-1 as a chute in the middle, the lock shell 1 has a second positioning column 1-2 in the second slotted hole 10-1; the lock shell 1 also has a bracket 1-3 permanently connected with at least two first sliding columns 1-4, which are parallel to and lie on both sides of the second slotted hole 10-1, the draw ring thrust box 10 has a channel for the first sliding columns 1-4 to pass through, the first sliding columns are provided with an elastomer 5-2 circumferentially with one end butting the outer wall of the draw ring thrust box 10 and the other end butting the bracket 1-3.

The draw ring control mechanism comprises a cylindrical part 11-1, a draw ring positioning plate 11-2 and a second sliding column 11-3; the cylindrical part 11-1 is arranged along the access direction of the draw ring 9, one end of the cylindrical part 11-1 is exposed out of the side panel 2, and the other end is provided with a channel for the second sliding column 11-3 to pass through, the second sliding column 11-3 is fixed on the base 1-5 of the lock shell 1, an elastomer 5-3 is set circumferentially on the second sliding column 11-3 with one end butting the cylindrical part 11-1 and the other end butting the base 1-5; the draw ring positioning plate 11-2 comprises a first straight bar 11-21 and a second straight bar 11-22, one end of the first straight bar 11-21 is hinged with the lock shell 1 and the other end hinged with the sidewall of cylindrical part 11-1, the central axes of the two hinge points B,C are parallel to each other; one end of the second straight bar 11-22 is permanently connected with the middle of the first straight bar 11-21 and the other end has a slip hook 11-23, and the draw ring thrust box 10 has a notch 10-2 to match the slip hook 11-23.

The draw ring positioning plate 11-2 has an axially symmetric pattern, the first and second straight bars 11-21, 11-22 are vertical to each other. The end of the second slotted hole 10-1 is provided with an anti-collision mute strip 10-3 to avoid the harsh metal impact sound when the second positioning column collides with the second slotted hole and make the draw ring keep mute upon popup, so as to help improve user comfort.

The lock shell 1 has a square bar hole 12-1 at the central axis of dial wheel 7 and mounting holes 12-2 on both sides of the square bar hole 12-1 to match machine screw and/or wood screw. The lower part of the lock shell 1 is also provided with a handle mounting hole 12-3 (for mounting handle 14), the lock shell 1 has a handle hole 12-4 on both sides of the handle mounting hole.

All elastomers in this embodiment are springs. In other embodiments, the elastomer could be a resilient mass of rubber or other resilient material.

The basic operating process of the lock body in this embodiment is as follows:

(1) Dead bolt: Under the action of a small external button 13, the dial wheel rotates and drives the thrust plate through the handle, then the thrust plate drives the dead bolt to enter and exit from the side panel. In this process, under the action of the elastomer and limit post, the hooks can automatically reset when the dead bolt draws back and timely pop up when the dead lock extends out.

(2) Draw ring: When the draw ring draws back into the lock shell, the slip hook of draw ring positioning plate joints the notch of the draw ring thrust box to play the positioning role; when popup of the draw ring is required, the end of cylindrical part is pressed at the side plate, then the cylindrical part drives the positioning plate to rotate around the hinge point B, disengaging the slip hook from the notch, the draw ring thrust box pops up the draw ring under the action of the elastomer and keeps silent.

Adjustable Strike Plate Embodiment

Figure 10:
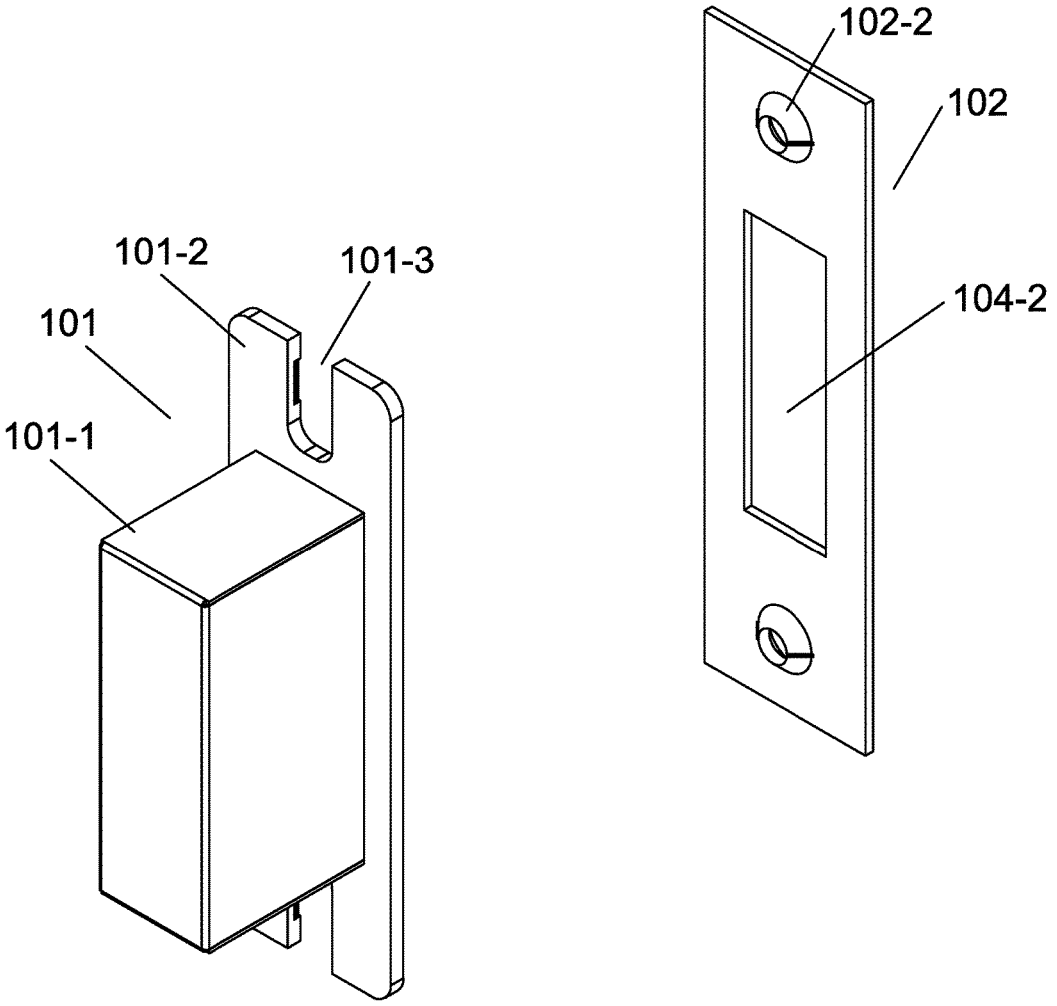
FIG. 10 is a perspective view of a lock body strike box with a strike plate exploded therefrom and showing how vertical adjustment therebetween is accommodated in an embodiment of this invention.
Figure 11:
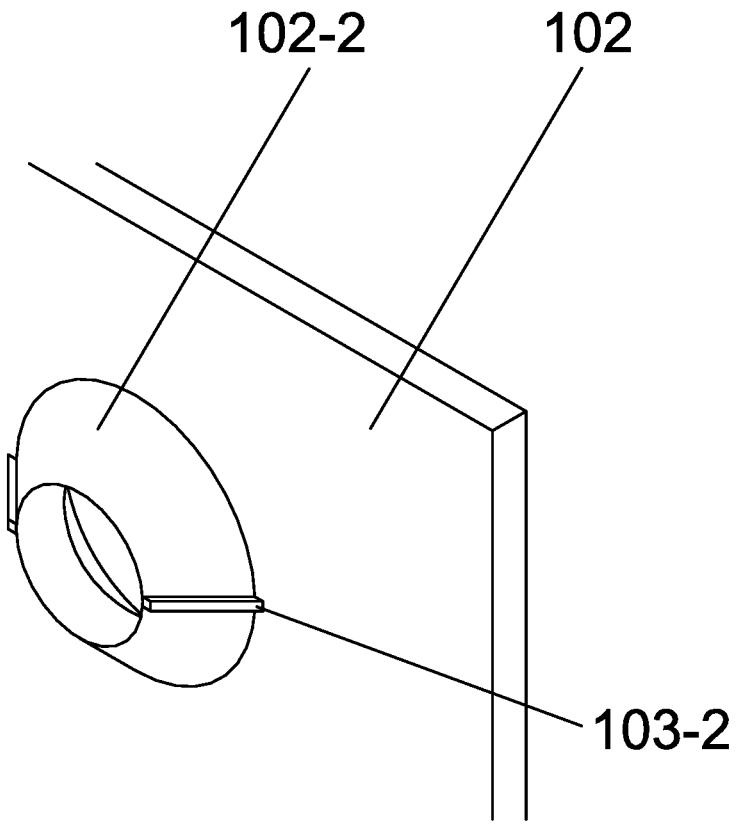
FIG. 11 is a perspective view of a hole position for a strike plate fastener of FIG. 10.
Figure 12:
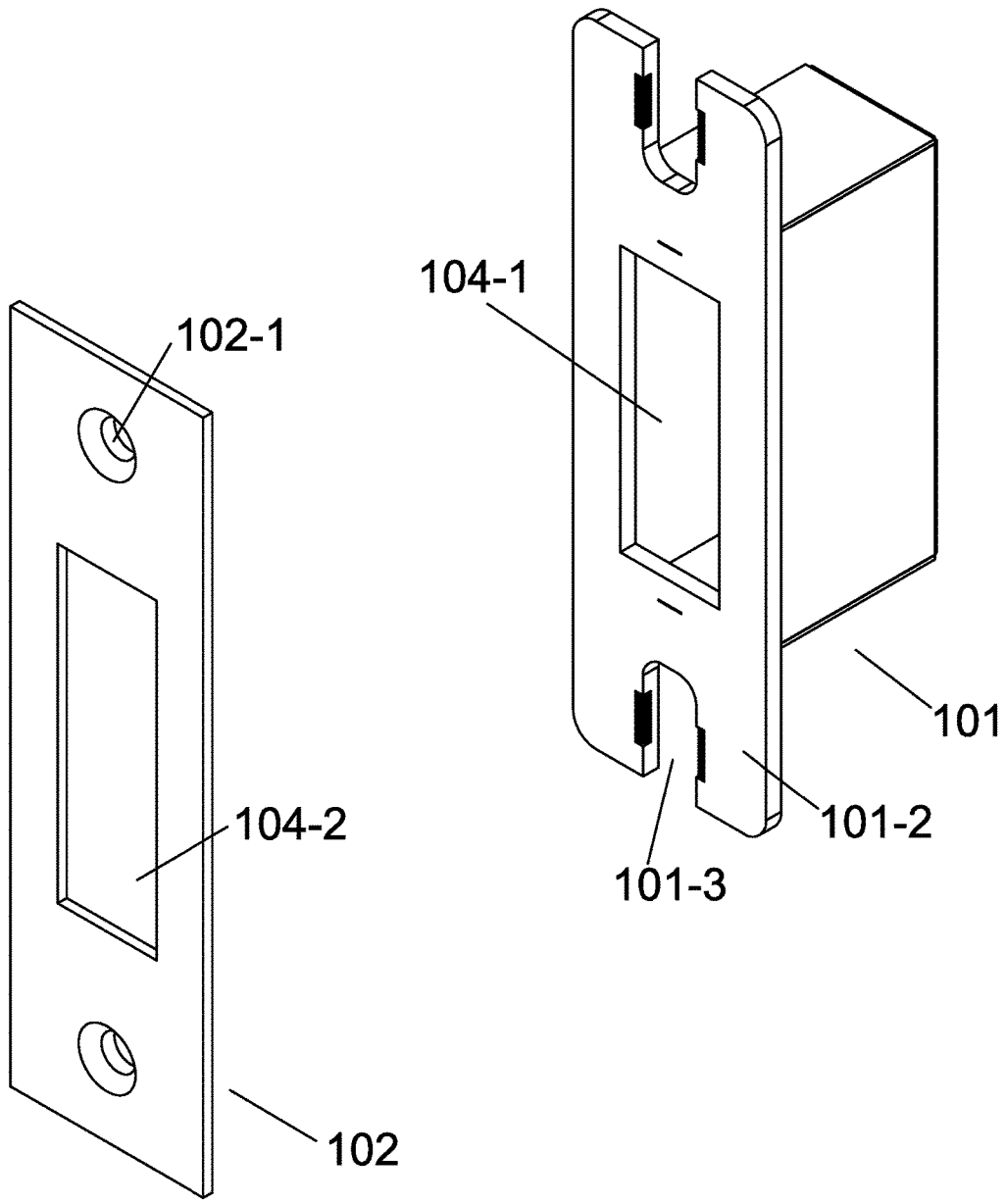
FIG. 12 is a perspective view of that which is shown in FIG. 10, but from an opposite viewpoint of the embodiment of FIG. 10.
Figure 13:
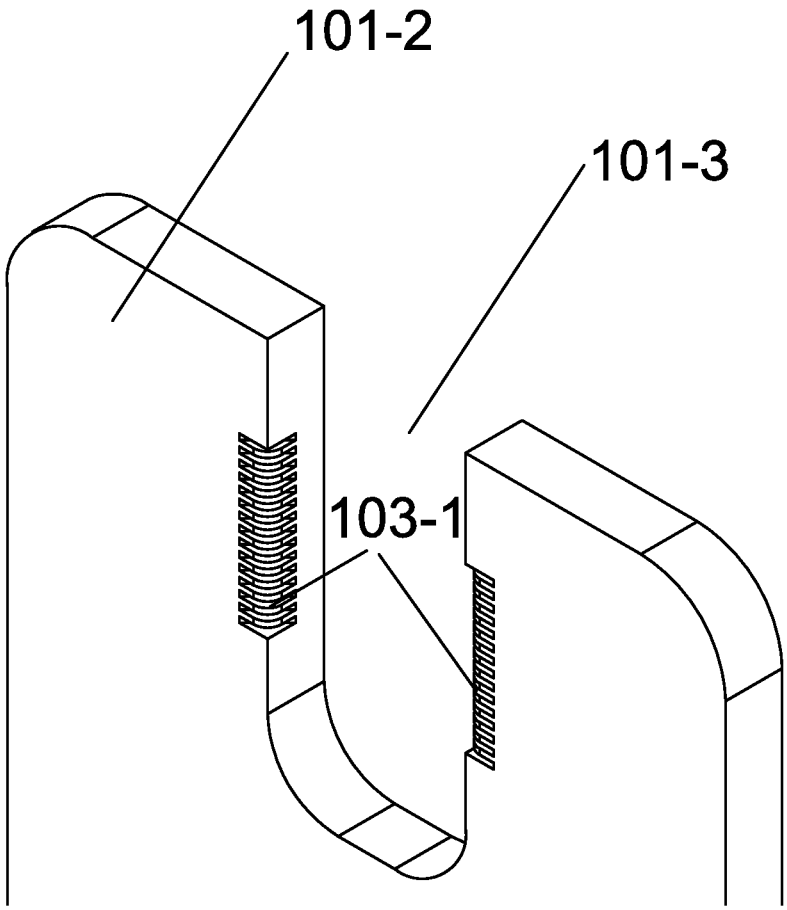
FIG. 13 is a perspective detail of a panel upper end portion of the strike box of FIGS. 10 and 12.

As shown in FIG. 10 to FIG. 13, the strike plate and strike box assembly for door locks in this embodiment comprises a lock receiving enclosure shown as a strike box 101 to be inserted into the door frame and a strike plate 102 to match the strike box 101. The strike box 101 comprises a box 101-1 and a panel 101-2 which is preferably permanently connected on a first side of the box 101-1 closest to the strike plate 102. The box 101-1 is open by way of a hole on this first side to allow portions of a lock mechanism to extend into the box 101-1 and through a corresponding hole in the panel 101-2.

Both upper and lower ends of the panel 101-2 reach beyond a second side of the box 101-1 non-parallel with the first side of the box 101-1. The panel 101-2 has a long groove 101-3 (shown open at an end, but optionally closed to be a slotted hole) on its upper and lower ends most preferably. The length direction of the long groove 101-3 extends vertically and coincides with the length direction of the panel 101-2. The long groove 101-3 has a set of slots 103-1 respectively on at least one side and preferably on both sides of the groove 101-3.

The strike plate 102 is provided with a fastening hole 102-1 on both upper and lower ends to correspond to the corresponding long groove 101-3. The fastening hole 102-1 has a sidewall 102-2 extending frusto-conically from the plane of the strike plate 102. The sidewall 102-2 has at least one clip bar 103-2 (or more clip bars) in the form of a slightly raised rib at a position able to come into contact with the corresponding long groove 101-3. The clip bar 103-2 joints into one of the corresponding slots 103-1. The strike plate 102 is preferably permanently (but selectively loosely or tightly) connected with the door frame and panel 101-2 by fasteners. Alternatively, the plate 102 can be separable from the panel 101-2 and door frame. The panel 101-2 is clamped between the strike plate 102 and door frame; the fasteners pass through the fastening hole 102-1 in the strike plate 102 and the long groove 101-3 in the panel 101-2 in turn.

The slots 103-1 on at least one side, but preferably both sides of the same long groove 101-3 are symmetrically distributed; the clip bars 103-2 on the sidewall 102-2 of the same fastening hole 102-1 are on at least one side of the sidewall 102-2 corresponding with the slots 103-1, and preferably on both sides, and preferably symmetrically distributed.

The slots 103-1 are preferably arranged transversely and parallel to one another; the clip bars 103-2 are arranged transversely to match with at least one slot 103-1. The orientations of the slots 103-1 and bars 103-2 are similar and preferably horizontal, but optionally non-horizontal. The sizes of the slots 103-1 and the bars 103-2 are similar such that the bars 103-2 can fit into one of the slots 103-1.

The box 101-1 of the strike box 101 preferably takes a rectangular shape at the hole in its first side. The panel 101-2 of the strike box 101 is preferably rectangular and permanently connected with the opened side of the box 101-1. The long groove 101-3 lies on both upper and lower ends of the panel 101-2 at the position which reaches beyond the box 101-1. The fastening hole 102-1 is preferably tapered frusto-conically. The panel 101-2 and strike plate 102 respectively have a rectangular lock hole 104-1, 104-2 in the middle.

In this embodiment, the strike plate 102 is securely connected with the panel 101-2 of strike box 101 by virtue of the joint between the slot 103-1 and clip bar 103-2. When the fastener connects the strike plate 102 with the door frame, the panel 101-2 of strike box 101 is fixed and uneasy to slide under the action of the joint structure. When it is necessary to fine-tune the vertical position of the strike box 101, the fastener is slightly loosened so that the strike plate 102 is slightly loose from the panel 101-2 of strike box 101. Then the vertical position of strike box 101 is fine-tuned to meet the requirements. After that, the strike plate 102 is fastened with the panel 101-2 of strike box 101 and the fastener is tightened. The whole fine-tuning process is very simple and convenient.

This disclosure is provided to reveal a preferred embodiment of the invention and a best mode for practicing the invention. Having thus described the invention in this way, it should be apparent that various different modifications can be made to the preferred embodiment without departing from the scope and spirit of this invention disclosure. When structures are identified as a means to perform a function, the identification is intended to include all structures which can perform the function specified. When structures of this invention are identified as being coupled together, such language should be interpreted broadly to include the structures being coupled directly together or coupled together through intervening structures. Such coupling could be permanent or temporary and either in a rigid fashion or in a fashion which allows pivoting, sliding or other relative motion while still providing some form of attachment, unless specifically restricted.

What is claimed is:

1. A handle lock body for sliding doors, the handle lock body comprising:

a lock shell and a side panel, the side panel is permanently connected with the lock shell;

a dead bolt is provided in the lock shell to be drive-jointed with a drive mechanism, the side panel has a through hole for the access of the dead bolt;

the dead bolt has a hollow rectangular dead bolt shell;

wherein, two hooks are symmetrically set along an access direction of the dead bolt, the access direction of the dead bolt being defined at least along a longitudinal direction of the dead bolt in which the dead bolt retracts in and extends out of the lock shell via the through hole during operation of the dead bolt;

the hooks are hinged with the dead bolt shell at hinge points which are located between two ends of the hooks;

an elastomer is set between the hooks where the elastomer biases each of the hooks in a corresponding extending direction which intersects with the access direction;

limit posts are provided in the lock shell to correspond to the hooks respectively, for providing contacting means for rotating the hooks;

the dead bolt has a first state that: when the dead bolt extends out of or draws back into the lock shell, the elastomer resists one end of the hooks to make the hooks positively rotate around the hinge point till the other end of the hooks retracts into the dead bolt shell;

the dead bolt has a second state that: when the dead bolt extends out of the lock shell and continues to move towards outside of the lock shell, the limit posts contact each respective one end of the hooks to make the hooks rotate reversely around the hinge point till the other end of the hooks extends out of the dead bolt shell and compresses the elastomer;

wherein the hooks have a strip-shaped sheet body, one end of the hooks extends out a first protrusion towards the other hook to contact the elastomer and a second protrusion towards the direction against the other hook to contact the corresponding limit post, the other end of the hooks extends out a hook-shaped part towards the direction against the other hook, the hinge point is located near where the hooks are adjacent to the second protrusion;

wherein the drive mechanism comprises a dial wheel with a handle and a thrust plate to match the handle, the thrust plate is parallel to the plane of hooks, the lock shell is perpendicular to the plane of hooks and to a portion of the side panel and forms a "C" shape, the hooks oriented in a plane that is perpendicular to the side panel, an opening end of the "C" shape clamps and is fixedly connected with the thrust plate and its closing end faces an outside of the lock shell; and wherein the opening end of the said "C" shape is permanently connected with the thrust plate with a set of rivets, and the tops of the rivets lie on the same side of the lock shell, when the dead bolt is at the second state and the hooks extend out of the dead lock shell, the second protrusion of the said hooks is clamped between the limit post and the thrust plate, and a gasket is provided between the dial wheel and the lock shell.

2. The handle lock body for sliding doors according to claim 1 wherein a limit bar is set in the dead bolt shell along the access direction of the dead bolt and the two hooks are distributed symmetrically on both sides of the limit bar.

3. The handle lock body for sliding doors according to claim 1 wherein the thrust plate has a first slotted hole as a chute, the lock shell has a first positioning column in the first slotted hole, the first positioning column is provided with a sleeve circumferentially to contact an inner wall of the first slotted hole, and the first slotted hole extends along the access direction of the dead bolt.

4. A handle lock body for sliding doors, the handle lock body comprising:

a lock shell and a side panel, the side panel is permanently connected with the lock shell;

a dead bolt is provided in the lock shell to be drive-jointed with a drive mechanism, the side panel has a through hole for the access of the dead bolt;

the dead bolt has a hollow rectangular dead bolt shell;

wherein, two hooks are symmetrically set along an access direction of the dead bolt, the access direction of the dead bolt being defined at least along a longitudinal direction of the dead bolt in which the dead bolt retracts in and extends out of the lock shell via the through hole during operation of the dead bolt;

the hooks are hinged with the dead bolt shell at hinge points which are located between two ends of the hooks;

an elastomer is set between the hooks where the elastomer biases each of the hooks in a corresponding extending direction which intersects with the access direction;

limit posts are provided in the lock shell to correspond to the hooks respectively, for providing contacting means for rotating the hooks;

the dead bolt has a first state that: when the dead bolt extends out of or draws back into the lock shell, the elastomer resists one end of the hooks to make the hooks positively rotate around the hinge point till the other end of the hooks retracts into the dead bolt shell;

the dead bolt has a second state that: when the dead bolt extends out of the lock shell and continues to move towards outside of the lock shell, the limit posts contact each respective one end of the hooks to make the hooks rotate reversely around the hinge point till the other end of the hooks extends out of the dead bolt shell and compresses the elastomer;

wherein the hooks have a strip-shaped sheet body, one end of the hooks extends out a first protrusion towards the other hook to contact the elastomer and a second protrusion towards the direction against the other hook to contact the corresponding limit post, the other end of the hooks extends out a hook-shaped part towards the direction against the other hook, the hinge point is located near where the hooks are adjacent to the second protrusion;

wherein the drive mechanism comprises a dial wheel with a handle and a thrust plate to match the handle, the thrust plate is parallel to the plane of hooks, the lock shell is perpendicular to the plane of hooks and to a portion of the side panel and forms a "C" shape, the hooks oriented in a plane that is perpendicular to the side panel, an opening end of the "C" shape clamps and is fixedly connected with the thrust plate and its closing end faces an outside of the lock shell;

wherein a draw ring and draw ring control mechanism are also set in the lock shell;

the side panel has a through hole for access of a draw ring;

a side of the draw ring facing the lock shell is permanently connected to a draw ring thrust box, the draw ring thrust box has a second slotted hole as a chute in a middle thereof, the lock shell has a second positioning column in the second slotted hole; and the lock shell also has a bracket permanently connected with at least two first sliding columns, which are parallel to and lie on both sides of the second slotted hole, the said draw ring thrust box has a channel for the first sliding columns to pass through, the first sliding columns provided with an elastomer extending circumferentially with one end butting the outer wall of the draw ring thrust box and an opposite end abutting the bracket.

5. The handle lock body for sliding doors according to claim 4 wherein the second slotted hole has an anti-collision mute strip at an end thereof.

6. The handle lock body for sliding doors according to claim 4 wherein the draw ring control mechanism comprises a cylindrical part, a draw ring positioning plate and a second sliding column;

the cylindrical part is arranged along the access direction of the draw ring, one end of the cylindrical part is exposed out of the side panel, and an opposite end thereof is provided with a channel for the second sliding column to pass through, the second sliding column is fixed on a base of the lock shell, an elastomer is set circumferentially on the second sliding column with one end abutting the cylindrical part and an opposite end thereof abutting the base;

the draw ring positioning plate comprises a first straight bar and a second straight bar, one end of the said first straight bar is hinged with the lock shell and the other end is hinged with a sidewall of the cylindrical part, central axes of two hinge points thereof are parallel to each other; and one end of the second straight bar is permanently connected with the middle of the first straight bar and the other end has a slip hook, and the draw ring thrust box has a notch to match the slip hook.

7. The handle lock body for sliding doors according to claim 6 wherein the draw ring positioning plate has an axially symmetric pattern, the first and second straight bars are each vertical; the lock shell has a square bar hole at the central axis of the dial wheel and mounting holes on both sides of the square bar hole to match a machine screw and/or a wood screw; and the lower part of the said lock shell is also provided with a handle mounting hole, the lock shell has a handle hole on both sides of the handle mounting hole.

8. The handle lock body for sliding doors according to claim 4 wherein a limit bar is set in the dead bolt shell along the access direction of the dead bolt and the two hooks are distributed symmetrically on both sides of the limit bar.

9. The handle lock body for sliding doors according to claim 1 wherein the thrust plate has a first slotted hole as a chute, the lock shell has a first positioning column in the first slotted hole, the first positioning column is provided with a sleeve circumferentially to contact an inner wall of the first slotted hole, and the first slotted hole extends along the access direction of the dead bolt.

* * * * *